United States Patent [19]

Martelli

[11] Patent Number: 5,009,420

[45] Date of Patent: Apr. 23, 1991

[54] BATTING PRACTICE METHOD

[76] Inventor: Joseph M. Martelli, 4242 W. Oak, Fullerton, Calif. 92633

[21] Appl. No.: 290,147

[22] Filed: Dec. 23, 1988

[51] Int. Cl.[5] ..... A63B 69/40

[52] U.S. Cl. ..... 273/26 R; 273/29 A

[58] Field of Search ..... 273/26 R, 29 R, 29 A, 273/26 C, 188 R, 189 R; 272/119, 121, 75, 135, 126

[56] References Cited

U.S. PATENT DOCUMENTS

| | | | |
|---|---|---|---|
| 1,530,519 | 3/1925 | Remington . | |
| 1,703,375 | 2/1929 | Volk . | |
| 2,592,771 | 4/1952 | Wampler . | |
| 2,893,736 | 7/1959 | Tesi | 273/188 R |
| 3,346,257 | 10/1967 | Whitney . | |
| 3,429,571 | 2/1969 | Abel . | |
| 3,442,513 | 5/1969 | Fisher . | |
| 3,491,726 | 1/1970 | Partin . | |
| 3,595,583 | 7/1971 | Oppenheimer . | |
| 3,698,721 | 10/1972 | Stewart . | |
| 3,843,119 | 10/1974 | Davis | 272/126 |
| 3,870,317 | 3/1975 | Wilson . | |
| 3,940,144 | 2/1976 | Dickie | 273/188 R |
| 3,997,921 | 12/1976 | Knight . | |
| 4,060,240 | 11/1977 | Dunston | 272/126 |
| 4,134,589 | 1/1979 | Arena | 273/188 R |
| 4,318,546 | 3/1982 | Chen . | |
| 4,544,155 | 10/1985 | Wallenbrock | 273/188 R |
| 4,659,084 | 4/1987 | Vuick . | |

FOREIGN PATENT DOCUMENTS

| | | | |
|---|---|---|---|
| 1400480 | 4/1965 | France | 272/126 |

*Primary Examiner*—Theatrice Brown

*Attorney, Agent, or Firm*—Gordon L. Peterson; Loyal M. Hanson

[57] ABSTRACT

A batting practice method using a batting practice device to restrain the batter's hips against certain movement while the batter is swinging the bat. The batting practice device is coupled to the batter and to a fixed location, and the batter executes a batting stroke as though a ball were moving along a path from one location and with the batter being located along the path intermediate such location and the fixed location. The batting practice device restrains the batter's hips against significant movement toward such one location while allowing the hips to pivot as the batter executes the batting stroke.

5 Claims, 1 Drawing Sheet

BATTING PRACTICE METHOD

BACKGROUND OF THE INVENTION

1. Technical Field

This invention relates generally to sports equipment, and more particularly to a method and apparatus for batting practice.

2. Background Information

In executing a good batting stroke, the batter maintains a somewhat rigid forward knee as he swings the bat and rotates his hips. In other words, he keeps the knee closest the pitcher from collapsing or buckling toward the pitcher. This promotes a level swing, proper head position, and good ball contact so that training aids designed to improve this aspect of batting are of interest.

One existing training aid described in U.S. Pat. No. 3,870,317 to Wilson utilizes a belt to be worn over the hips of the user in order to develop proper hip turn and body rotation during a swinging motion. Particularly adapted for the golfer, it includes an elastomeric web section attached to the belt over the hip which is secured to a tree or stake with a length of rope. The user leans toward the point of attachment prior to the back swing, with the web section tending to rotate the body during the forward swing. However, the Wilson training aid does not operate to encourage a rigid forward knee while batting.

U.S. Pat. No. 1,703,375 to Volk describes another training aid designed to improve the golf swing of a user that employs a belt worn around the waist and secured with cords to a wall. U.S. Pat. No. 4,134,589 to Arena describes yet another golf training aid that utilizes a cord hooked onto the user's belt loops and secured to a stake in the ground ahead of the golfer. But like the Wilson training aid, neither the Volk training aid nor the Arena training aid operates to encourage a somewhat rigid forward knee while batting.

Consequently, it is desirable to have a method and apparatus for this purpose—a batting practice method and apparatus to better help the batter develop a good batting stroke in which the forward knee is maintained somewhat rigid.

SUMMARY OF THE INVENTION

This invention solves the problems outlined above by restraining the batter's hips against forward movement while still permitting them to pivot during the swing. This is accomplished in one embodiment with a belt worn over the batter's hips that is secured to a fixed object behind the batter utilizing two lines and a pulley arrangement. This operates to significantly restrain forward movement of the hips (toward the direction from which the ball is being pitched) without significantly impairing pivotal movement of the hips, and this results in the hip motion normally accompanying a somewhat rigid forward knee.

Generally, a batting practice apparatus according to the invention includes a first elongated flexible member or first line having a length sufficient to extend behind and between the hips of a user. Components are provided for securing a first end portion of the first line to the body of the user adjacent a first one of the hips and a second end portion of the first line to the body of the user adjacent a second one of the hips. These may include a belt with first and second loops to which the first line can be tied.

The invention also includes a second elongated flexible member or second line for attachment to a separate support structure, the second line having a length sufficient to extend from the separate support structure to the first line when the first line is secured to the body of the user and the user is in a desired batting position. Components are provided for attaching a first end portion of the second line to the first line so that with a second end portion of the second line secured to the separate support structure and the batter in the desired batting position forward movement of the hips of the user is significantly restrained without significantly impairing pivotal movement of the hips. This may be done with a pulley secured to the first end portion of the second line, the pulley having a pulley wheel over which the first line rides.

In line with the above, a method of batting practice includes restraining the hips of a batter posteriorly of the body of the batter against significant forward movement while allowing the hips to pivot as the batter executes a batting stroke. This may be done with the batting practice apparatus described above.

In one form, the batting practice method includes the step of providing a first line having a length sufficient to extend behind and between the hips of a user and the step of securing a first end portion of the first line to the body of the user adjacent a first one of the hips and a second end portion of the first line to the body of the user adjacent a second one of the hips.

A second line is also provided for attachment to a separate support structure, the second line having a length sufficient to extend from the separate support structure to the first line when the first line is secured to the body of the user and the user is in a desired batting position. The method proceeds by attaching a first end portion of the second line to the first line and the second end portion of the second line to the separate support structure so that with the batter in the desired batting position forward movement of the hips of the user is significantly restrained without significantly impairing pivotal movement of the hips.

The method may include providing a belt adapted to be worn by the user in a position generally over the hips, which belt includes first and second loops that are dimensioned and arranged to enable a user to secure the first and second end portions of the first line to them. In such a case, the method proceeds by securing the first and second end portions of the first line to respective ones of the first and second loops and securing the belt on the user.

The method may also include providing a connector device secured to the first end portion of the second line, the connector device defining an opening through which the first line extends. The connector device can be a pulley secured to the first end portion of the second line, the pulley having a pulley wheel and the first line riding over the pulley wheel, and the method may proceed by having the user execute a batting stroke with the hips so restrained in order to encourage the batter to keep the forward knee of the batter somewhat rigid.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
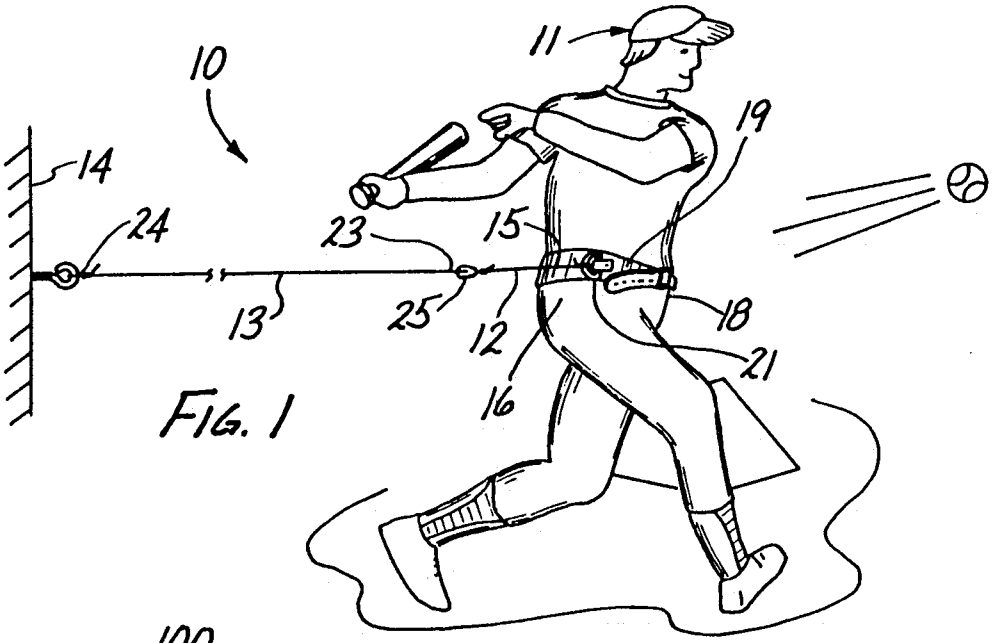
FIG. 1 of the drawings is a pictorial showing a batter using a batting practice apparatus constructed according to the invention.

Referring now to the drawings, there is show a batting practice apparatus 10 constructed according to the invention (FIGS. 1-3) that is being utilized during batting practice by a batter or user 11 (FIG. 1). Generally, the apparatus 10 includes a first flexible, elongated member or first line 12 having a length sufficient to extend behind and between the hips of the user 11, and a second flexible, elongated member or second line 13 for attachment to a separate support structure 14 (FIG. 1), such as a stake in the ground, a tree, the framework of a batting cage, or a backstop fence, for example, the second line 13 having a length sufficient to extend from the separate support structure 14 to the first line 12 when the first line 12 is secured to the user 11 and the user 11 is in a desired batting position. The lines 12 and 13 may be conventional one-quarter inch nylon rope, for example, in order that they can flex as the user 11 executes a batting stroke.

Figure 2:
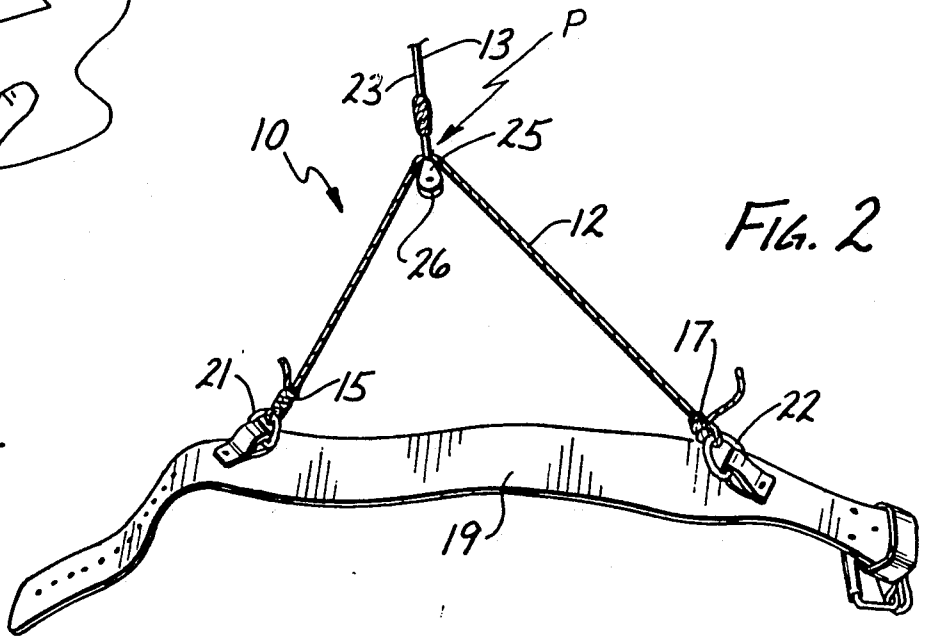
FIG. 2 is a enlarged perspective view of the apparatus showing details of the belt, the first and second lines, and the pulley arrangement.

Means are provided for securing a first end portion 15 of the first line 12 to the user 11 adjacent a first one of the hips (designated hip 16 in FIG. 1) and a second end portion 17 of the first line 12 to the user adjacent a second one of the hips (hip 18 in FIG. 1). The illustrated apparatus 10 employs a belt 19 for this purpose. It is composed of a suitable flexible material, such as leather, and it can be buckled or otherwise secured around the waist of the user 11 generally over the hips 16 and 18. The belt 19 includes a first loop 21 to which the first end portion 15 of the first line 12 is secured by suitable means, such as a knot, and a second loop 22 to which the second end portion 17 of the first line 12 is similarly secured (FIG. 2). The first and second loops may be metal D-rings suitably secured to the belt by known means, for example.

Means are also provided for attaching a first end portion 23 of the second line 13 to the first line 12 so that with a second end portion 24 of the second line 13 secured to the separate support structure 14 (by suitable means such as a knot through an eyebolt secured to the support structure 14) and the user 11 in the desired batting position, forward movement of the hips 16 and 18 of the user 11 is significantly restrained without significantly impairing pivotal movement of the hips.

This is accomplished in the illustrated embodiment with a connector or pulley 25, such as a commercially available pulley, through which the first line 12 extends movably. It serves as means for attaching the first end portion 23 of the second line 13 to the first line 12 at a point of attachment P (FIG. 2) intermediate the first and second end portions 15 and 17 of the first line 12 so that the point of attachment P can move along the first line 12 during pivotal movement of the hips. In that regard, the first line 12 is sufficiently long so that the first line 12 is at least slightly spaced apart from the belt 19 in order that movement of the pulley 25 along the first line 12 is not significantly impaired. Thus, the point of attachment P at which the second line 13 is connected to the first line 12 can move along the first line 12 during pivotal movement of the hips 16 and 18 so that the pivotal movement is not significantly impaired.

Figure 3:
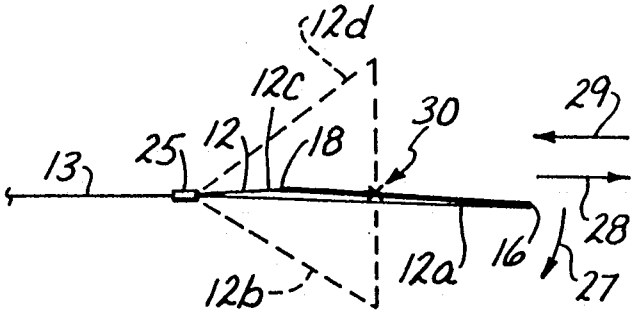
FIG. 3 is a diagrammatic view showing operation of the apparatus.

As an example of how the point of attachment P at which the second line 13 is connected to the first line 12 moves, consider pivotal movement of the hips 16 and 18 in the direction of an arrow 27 in FIG. 3, from the position illustrated in solid lines to the position illustrated in dashed lines. As this occurs, a first section **12*a* of the first line 12 extending between the pulley 25 and the first hip 16 decreases in length to a first section 12*b* illustrated in dashed lines, while a second section 12*c* extending between the pulley 25 and the second hip 18 increases in length to a second section 12*d*** illustrated in dashed lines.

This action allows pivotal movement of the hips 16 and 18 in the direction of the arrow 27 while significantly restraining movement of the hips in the direction of an arrow 28, generally parallel to the direction of an approaching baseball as depicted by an arrow 29 in FIG. 3. The pulley 25 includes a pulley wheel 26 over which the first line 12 rides for this purpose. However, a connector with just an opening and no pulley wheel may be used within the broader inventive concepts disclosed, with the first line 12 moving by sliding through the connector instead of riding over a pulley wheel.

The support structure 14 is selected so that the second line 13 extends generally parallel to the path the approaching baseball will travel. In terms of a conventional baseball playing field with the user 11 in the batter's box, this means that the second line 13 is generally parallel to a line extending from home plate to the pitching mound. It may extend directly back to the backstop fence, for example, and be tied onto the fence. As the user 11 executes a batting stroke in order to hit an approaching baseball, the apparatus 10 functions to significantly restrain forward movement of the hips. In other words, as the user 11 swings at the baseball, the apparatus 10 significantly restrains movement of the hips away from the support structure 15 toward the direction from which the approaching baseball was pitched. This helps prevent the knee of the forward leg from collapsing or buckling and it is done without significantly impairing pivotal movement of the hips.

In that regard, pivotal movement of the hips refers to pivotal movement about a point 30 in FIG. 3 that is generally midway between the hips. Forward movement of the hips refers to movement of the point 30 in the general direction of the arrow 28, and forward movement of the hips is significantly restrained when movement of the point 30 is only slight as compared to what could occur when a batting stroke is executed without using the apparatus 10. In that regard, pivotal movement of the hips is not significantly impaired if restrained only slightly.

In other words, the hips of the user 11 are restrained posteriorly of the body of the user 11 (opposite the direction from which the baseball approaches) against significant forward movement while allowing the hips to pivot as the batter executes a batting stroke.

Figure 4:
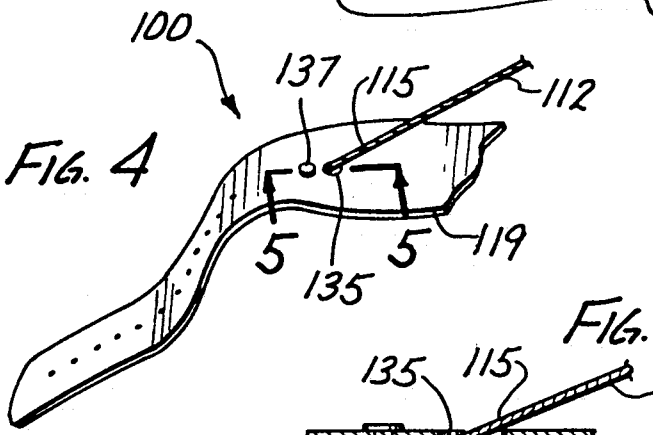
FIG. 4 is a fragmentary perspective view of an enlarged portion of a second embodiment constructed according to the invention in which the first line is composed of a metal alloy.
Figure 5:
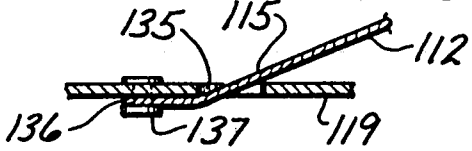
FIG. 5 is a further enlarged cross sectional view of the second embodiment taken on line 5—5 of FIG. 4.

Considering now FIGS. 4 and 5, there is shown another apparatus constructed according to the invention, an apparatus 100. For convenience, reference numerals for the belt, the first line, and the first end portion of the first line are increased by one hundred over those designating similar parts of the apparatus 10.

Similar to the apparatus 10, the apparatus 100 includes a first line 112 having a first end portion 115 secured to a belt 119. However, the first line 112 is in the form of a wire composed of a metal alloy, such as steel. It may utilize any of various constructions, such as being a solid wire or a braided cable. But in any case it is a flexible, elongated member that is somewhat more rigid that the first line 12 of the apparatus 10. As a consequence, the first line 112 tends to support itself in a generally fixed position relative to the belt 119, whereas the first line 12 of the apparatus 10 can more easily sag downwardly under influence of gravity.

The first end portion 115 of the first line 112 extends through an opening 135 in the belt 119 to a distal end portion 136 of the first line 112, and the distal end portion 136 is secured to the belt 119 by suitable means, such as a metal rivet 137. A second end portion of the first line 112 (not shown) may be similarly secured to the belt 119.

Operatively, the method of the invention includes providing a first line having a length sufficient to extend behind and between the hips of a user and a second line for attachment to a separate support structure located behind the user, generally opposite the direction from which the baseball approaches, the second line having a length sufficient to extend from the separate support structure to the first line when the first line is secured to the body of the user and the user is in a desired batting position. The method proceeds by securing a first end portion of the first line to the body of the user adjacent a first one of the hips and a second end portion of the first line to the body of the user adjacent a second one of the hips, and by securing a first end portion of the second line to the first line and the second end portion of the second line to the separate support structure so that with the batter in the desired batting position forward movement of the hips of the user is significantly restrained without significantly impairing pivotal movement of the hips. This may be done in a manner described above with either the apparatus 10 or the apparatus 100.

Thus, the step of securing a first end portion of the first line to the body of the user adjacent a first one of the hips and a second end portion of the first line to the body of the user adjacent a second one of the hips may include providing a belt adapted to be worn by the user in a position generally over the hips, which belt includes first and second loops that are dimensioned and arranged to enable a user to secure the first and second end portions of the first line to them. The first and second end portions of the first line are secured to respective ones of the first and second loops, and the belt is secured on the user.

Similarly, the step of attaching a first end portion of the second line to the first line may include providing a connector device secured to the first end portion of the second line through which the first line extends movably. The connector device may be a pulley secured to the first end portion of the second line, the pulley having a pulley wheel and the first line riding over the pulley wheel.

In addition to the above, the method may include the steps of having the user execute a batting stroke with the hips so restrained in order to encourage the batter to keep the forward knee of the batter somewhat rigid.

Thus, this invention restrains the hips against forward movement while still permitting them to pivot during the swing. This is accomplished in one embodiment with a belt worn over the batter's hips that is secured to a fixed object behind the batter utilizing two lines and a pulley arrangement. This operates to significantly restrain forward movement of the hips without significantly impairing pivotal movement of the hips to result in the hip motion normally accompanying a batting stroke executed with a somewhat rigid forward knee.

Although an exemplary embodiment of the invention has been shown and described, many changes, modifications, and substitutions may be made by one having ordinary skill in the art without necessarily departing from the spirit and scope of the invention.

What is claimed is:

1. A batting practice method wherein a batter is to execute a batting stroke as though a ball were moving along a path from one location in a first direction and with the batter located along said path intermediate said one location and a fixed location, said method comprising:

positively restraining the hips of the batter with a device which is coupled to the batter and to said fixed location against significant movement toward said one location while allowing the hips to pivot as the batter executes the batting stroke.

2. A method as defined in claim 1 wherein the device extends generally horizontally between the batter and the fixed location.

3. A method as defined in claim 1 including propelling a ball along said path from said one location in said first direction.

4. A batting practice method comprising:

providing a batting practice device which includes a first line and which can restrain the hips of a batter against significant movement in one direction while allowing the hips to pivot as the batter executes a batting stroke;

coupling the first line to a batter to form a loop extending from the waist of the batter and with such loop being coupled to a fixed location; and executing a batting stroke of the bat with the batter positioned generally between the fixed location and a first location from which a ball is assumed to come during such batting stroke and with the batting practice device restraining the hips of the batter against significant movement toward said first location while allowing the hips of the batter to pivot.

5. A method as defined in claim 4 including propelling a ball from said first location prior to said step of executing.

* * * * *